United States Patent [19]

Ikemura

[11] Patent Number: 4,768,475

[45] Date of Patent: Sep. 6, 1988

[54] VALVE MECHANISM FOR AN AUTOMOTIVE ENGINE

[75] Inventor: Makoto Ikemura, Tokyo, Japan

[73] Assignee: Fuji Jukogyo Kabushiki Kaisha, Tokyo, Japan

[21] Appl. No.: 18,504

[22] Filed: Feb. 25, 1987

[30] Foreign Application Priority Data

Feb. 28, 1986 [JP] Japan ..... 61-43595

[51] Int. Cl.[4] ..... F01L 1/34

[52] U.S. Cl. ..... 123/90.16; 123/90.17

[58] Field of Search ..... 123/90.15, 90.16, 90.17, 123/90.44, 90.39

[56] References Cited

U.S. PATENT DOCUMENTS

| | | | |
|---|---|---|---|
| 4,252,093 | 2/1981 | Hazelrigg | 123/90.16 |
| 4,253,434 | 3/1981 | Takizawa et al. | 123/90.15 |
| 4,354,460 | 10/1982 | Mae et al. | 123/90.16 |
| 4,523,550 | 6/1985 | Mazsuura | 123/90.16 |
| 4,607,600 | 8/1986 | Yoshizaki et al. | 123/90.16 |
| 4,611,558 | 9/1986 | Yoshizaki et al. | 123/90.16 |
| 4,612,884 | 9/1986 | Ajiki et al. | 123/90.16 |
| 4,612,887 | 9/1986 | Yoshizaki | 123/90.16 |
| 4,617,880 | 10/1986 | Yoshizaki | 123/90.16 |
| 4,656,977 | 4/1987 | Nagahiro et al. | 123/90.16 |

FOREIGN PATENT DOCUMENTS

| | | | |
|---|---|---|---|
| 0044314 | 4/1977 | Japan | 123/90.15 |
| 0211516 | 12/1983 | Japan | 123/90.15 |
| 0150410 | 8/1985 | Japan | 123/90.15 |
| 0233306 | 11/1985 | Japan | 123/90.16 |

*Primary Examiner*—Willis R. Wolfe
*Assistant Examiner*—M. Macy
*Attorney, Agent, or Firm*—Martin A. Farber

[57] ABSTRACT

A valve mechanism for an intake valve has a cam block including a first cam and a second cam. Each of the first and second cams has a common base circle. A first rocker arm engaging with the first cam and a second rocker arm engaging with the second cam are provided. The arms have holes in which three pins engage to selectively connect the first and second rocker arms with the actuating arm so as to be rocked together with the actuating arm. The mechanism is arranged to engaged and disengage the central pin with and from both the holes of the first and second rocker arms at a time when both the rocker arms engage with the base circles at the same time.

3 Claims, 6 Drawing Sheets

VALVE MECHANISM FOR AN AUTOMOTIVE ENGINE

BACKGROUND OF THE INVENTION

The present invention relates to a valve mechanism for an automotive engine.

In order to improve combustion in an entire range of engine speed, it is preferable to vary the valve lift and valve timing in accordance with engine speed.

A two-intake-valve type engine, each cylinder of which has two intake valves and two exhaust valves is known. In the prior art, each intake (exhaust) valve is provided with a rocker arm. An actuator is provided to operatively connect both rocker arms with each other in a high engine speed range to operate both intake valves. In a low engine speed range, both the intake valves are disconnected and one of valves is operated while the other is closed.

However, such a mechanism can not be applied to an ordinary single valve type engine in which each cylinder has a single intake valve and a single exhaust valve.

SUMMARY OF THE INVENTION

The object of the present invention is to provide a valve mechanism which may change the valve lift and valve timing of a valve for a cylinder.

According to the present invention, there is provided a valve mechanism for an automotive engine having intake valves and exhaust valves, a cam shaft having cams, and rocker arms rocked by the cams to operate the valves. The mechanism comprises each of the cams including a first cam for low engine speed, and a second cam for high engine speed which are different in shape of contour, each of the first and second cams having a base circle, each of the rocker arms including a first rocker arm engaging with the first cam, a second rocker arm engaging with the second cam, and an actuating arm engaging an end of a valve stem, the first, second rocker arms and actuating arm being rotatably mounted on a rocker arm shaft so as to be independently rocked, first means for engaging the actuating arm with the first rocker arm and the second rocker arm so as to be rocked together by the first cam and the second cam, second means for operating the first means so as to selectively engage and disengage the actuating arm with either of the first and second rocker arms at a time when both the rocker arms engage with the base circles of the corresponding cams at the same time, and wherein the first means comprises holes formed in the first and second rocker arms and actuating arm at positions at which the holes coincide with each other when the rocker arms engage with the base circles and three pins operated by the second means, and the three pins are so arranged that a central pin engaged with the hole of the actuating arm engages with the hole of the first rocker arm or the hole of the second rocker arm.

The other objects and features of this invention will become understood from the following description with reference to the accompanying drawings.

DETAILED DESCRIPTION OF THE PREFERRED EMBODIMENTS

Figure 1:
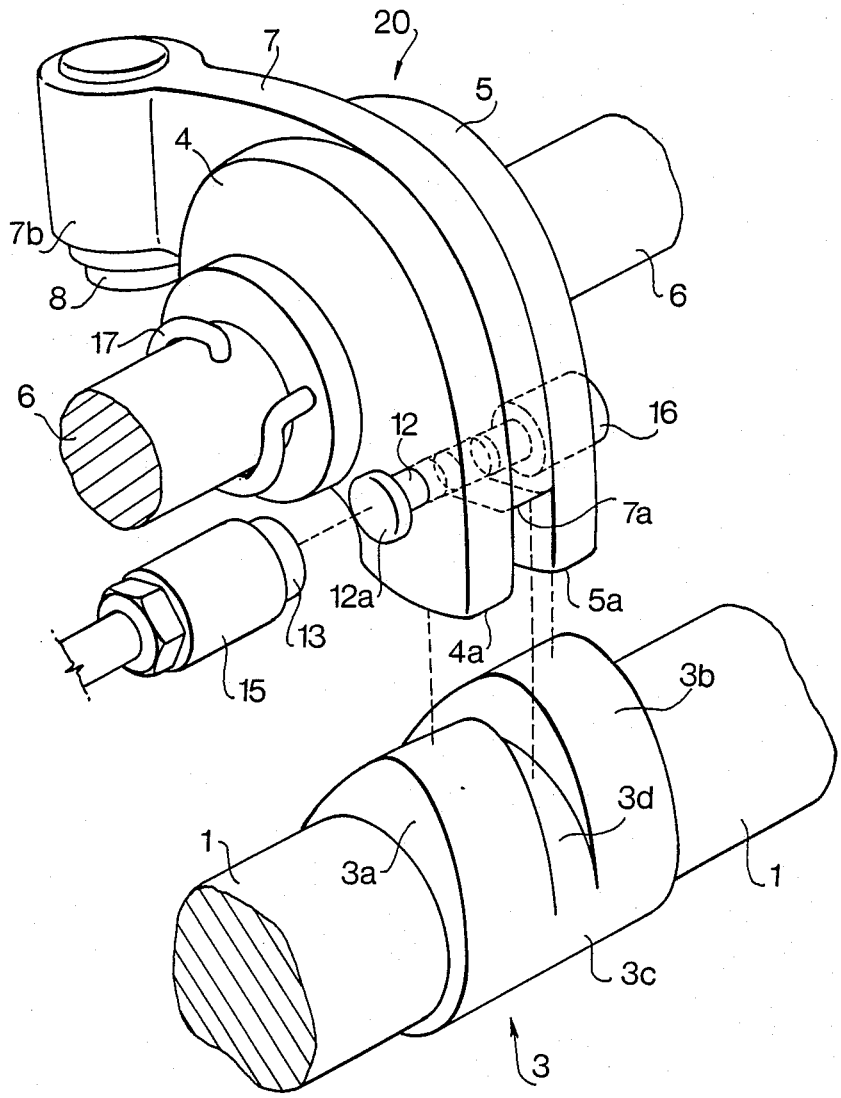
FIG. 1 is an exploded perspective view showing a part of a valve mechanism according to the present invention.
Figure 2:
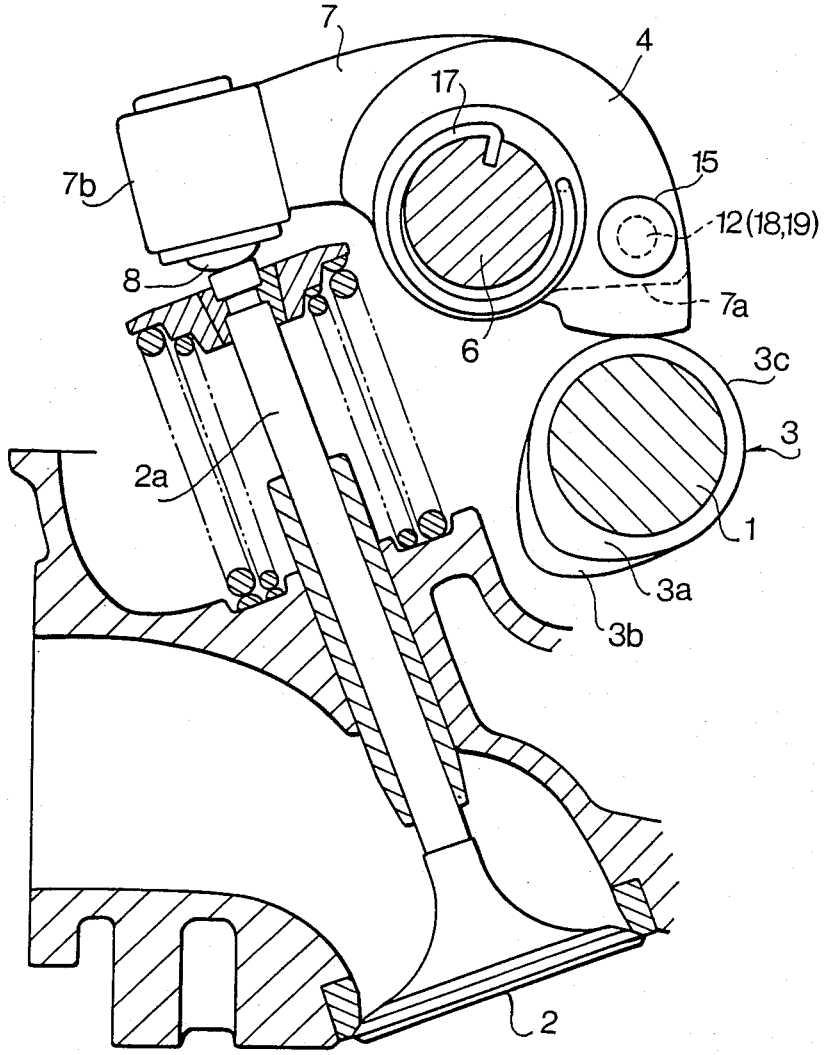
FIG. 2 is a sectional side view of the valve mechanism.

Referring to FIGS. 1 and 2, a valve mechanism for a valve 2 (for example, an intake valve) according to the present invention comprises a camshaft 1, a cam block 3 formed on the camshaft 1, a rocker arm shaft 6, and a rocker arm assembly 20 formed on the rocker arm shaft 6.

The cam block 3 comprises a first cam **3*a* for low engine speed, a second cam 3*b* for high engine speed, and a cylindrical portion 3*d* having a circular contour and provided between the first and second cams 3*a* and 3*b*. The first cam 3*a* is formed to have a low lobe to provide a low valve lift for the valve 2. The second cam 3*b* is formed to have a high lobe to provide a high valve lift. Each of the cams 3*a* and 3*b* has a common base circle 3*c* which is equal to the diameter of the cylindrical portion 3*d***.

The rocker arm assembly 20 on the rocker arm shaft 6 comprises a first rocker arm 4 and a second rocker arm 5, both having the same configuration, and an actuating arm 7 disposed between the first and second rocker arms 4 and 5. The first rocker arm 4 has an end **4*a* corresponding to the first cam 3*a* of the cam block 3. The second rocker arm 5 has an end 5*a* corresponding to the second cam 3*b*. Each of the first and second rocker arms 4 and 5 is urged by a spring 17 secured between the outside thereof and the rocker arm shaft 6, so that each of ends 4*a* and 5*a* is pressed against the first cam 3*a* and the second cam 3*b*, respectively. The actuating arm 7 has an end 7*a* formed shorter than the ends 4*a* and 5*a*. An opposite end 7*b* of the actuating arm 7 is provided with a valve-lash adjuster 8 and engaged with a tip of a stem 2*a* of the valve 2**.

As shown in FIG. 2, the mechanism is so arranged that when the common base circle **3*c* of the first and second cams 3*a* and 3*b* engages with the ends 4*a* and 5*a* of the first and second rocker arms 4 and 5, lateral holes 9 and 11 (FIG. 3) of the first and second rocker arms 4 and 5 coincide with a lateral hole 10 of the actuating arm 7**.

Figure 3:
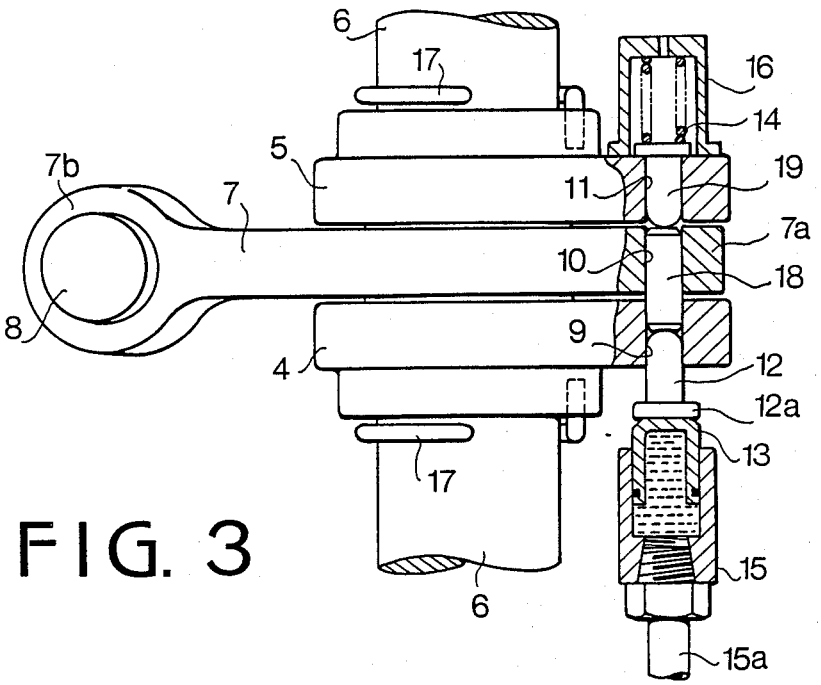
FIGS. 3 and 4 are plan views of the valve mechanism, partly in section, showing operations of pins.
Figure 4:
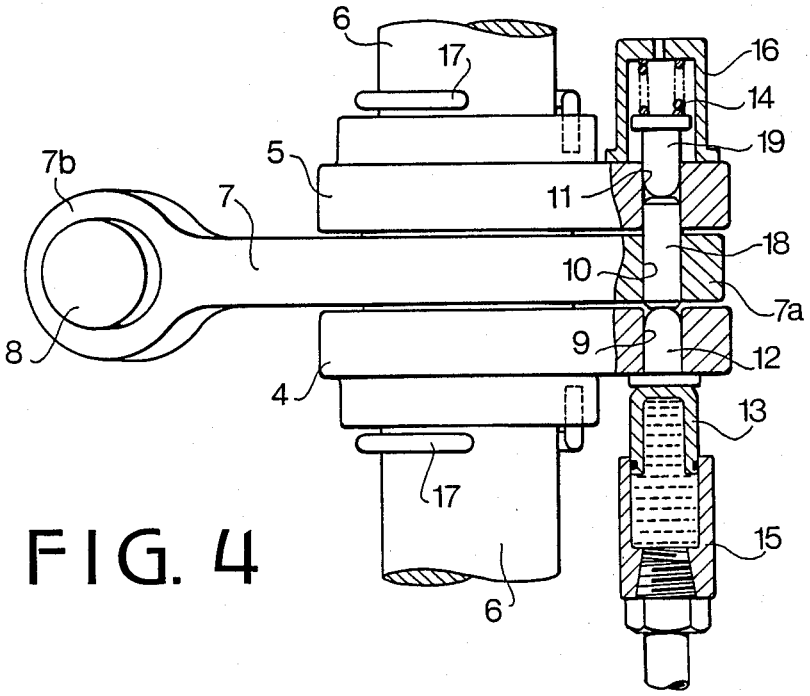

Referring to FIGS. 3 and 4, a pin 12 having a head **12*a* is slidably engaged with the hole 9. A lateral oil hydraulic cylinder 15 secured to a pipe 15*a* which is mounted in a frame (not shown) is disposed adjacent to the pin 12 and a piston 13 is slidably engaged in the cylinder 15. The head 12*a* of the pin 12 is engaged with the outer end surface of the piston 13. A slidable pin 18 is slidably engaged with the hole 10 and formed to have a longer length than that of the lateral hole 10. The second rocker arm 5 has a housing 16 integrally formed on an outer side wall of the arm 5. A pin 19 and a spring 14 are provided in the housing 16. The pin 19 is inserted into the hole 11 by a spring 14. When the holes 9, 10** and 11 coincide with each other, both ends of the pin 18 are adapted to project into the holes 9 or 11.

Referring to FIGS. 3 to 6, the operation of the valve 2 at a low engine speed and a light load on the engine will be hereinafter described. In order to control the intake flow of the valve by reducing the valve lift and valve opening degree, the first cam 3*a* is selected as follows.

Figure 5:
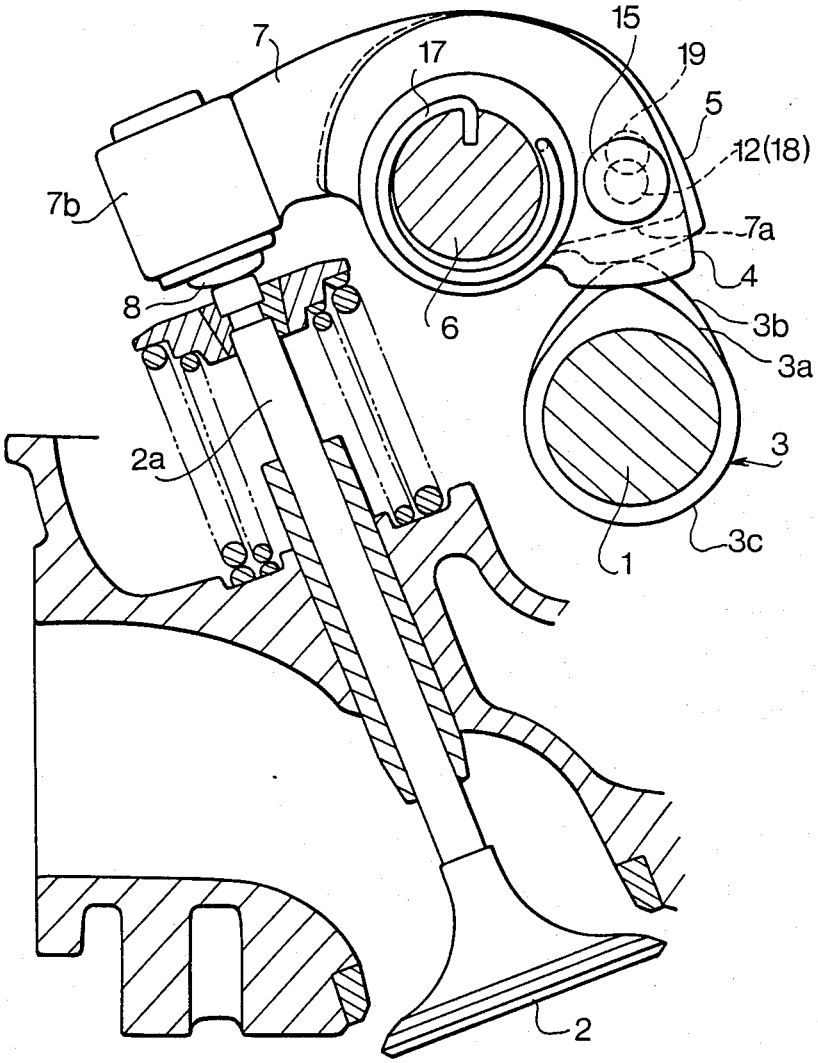
FIG. 5 is a sectional side view showing an operation of the valve mechanism in which a valve is opened at a small lift.

The oil in the hydraulic cylinder 15 is drained to reduce the pressure of the oil. When the common base circle 3*c* of the first and second cams 3*a* and 3*b* engages with the ends 4*a* and 5*a* of the first and second rocker arms 4 and 5, holes 9, 10 and 11 coincide with each other. Accordingly, the pin 19 is entirely inserted into the hole 11 by the spring 14 to push out the pin 18 from the hole 11, as shown in FIG. 3. The pin 18 projects further into the hole 9, and the piston 13 is retracted. Thus, the second rocker arm 5 is disengaged from the actuating arm 7, while the actuating arm 7 is integrated with the first rocker arm 4. Accordingly, as shown in FIG. 5, the first rocker arm 4 follows the first cam 3*a* to rock the actuating arm 7, so that the valve 2 opens at a small lift and a small valve opening degree (110°). The second rocker arm 5 is idly rocked by the second cam 3*b*.

Figure 6:
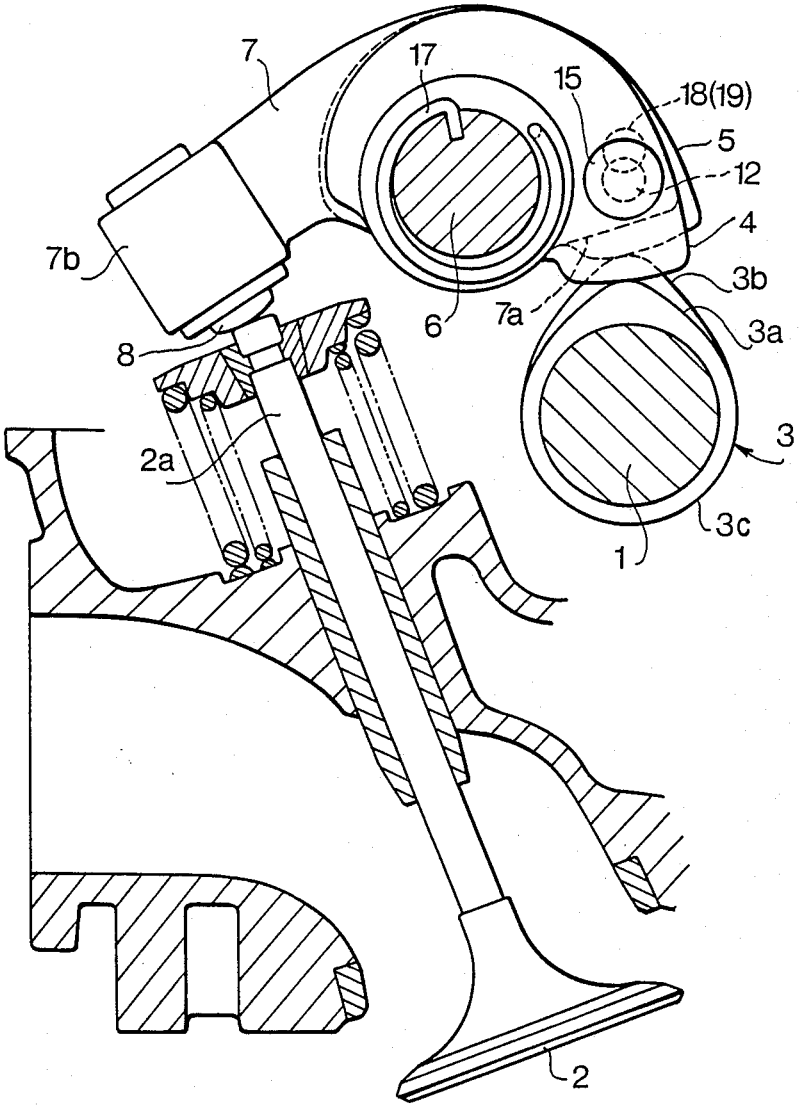
FIG. 6 is a sectional side view showing an operation of the valve mechanism in which the valve is opened at a large lift.

When the oil is supplied to the cylinder 15, and the first and second rocker arms 4 and 5 engage with the base circle 3*c* to coincide holes 9, 10 and 11 with each other, the piston 13 pushes the pin 12 against the spring 14. As shown in FIG. 4, the pin 12 is entirely engaged in the hole 9 to retract the pin 18 from the hole 9. Thus, the first rocker arm 4 is disengaged from the actuating arm 7. The pin 18 is projects further into the hole 11 to connect the actuating arm 7 with the second rocker arm 5. As shown in FIG. 6, the actuating arm 7 is rocked by the second rocker arm 5 which follows the second cam 3*b* to open the valve 2 at a large lift and a large opening degree (140°). The first rocker arm 4 is idled by the first cam 3*a*.

Figure 7:
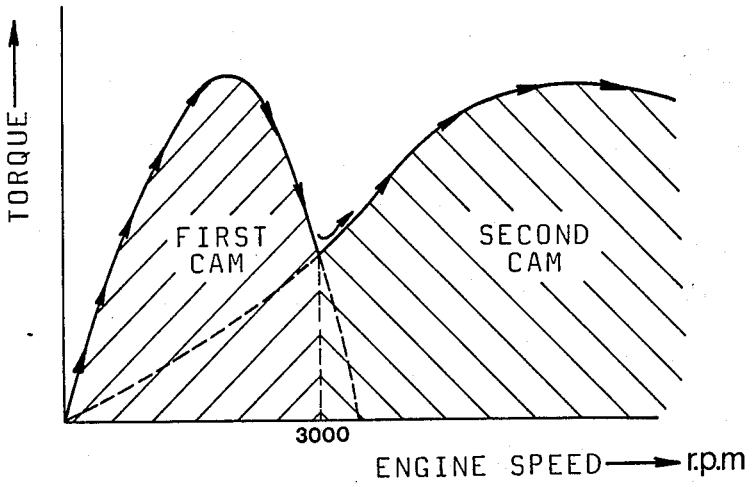
FIG. 7 is a graph showing a relationship between torque and engine speed.

FIG. 7 shows the relationship between torque and engine speed. The low engine speed cam 3*a* and the high engine speed cam 3*b* are interchanged, for example, at 3000 r.p.m. of the engine speed. The valve opening degree by the low engine speed cam 3*a* is set about 110° and that of the high engine speed cam 3*b* is about 140°. As seen from FIG. 7, a high torque is obtained in the high speed range as well as in the low speed range.

Figure 8:
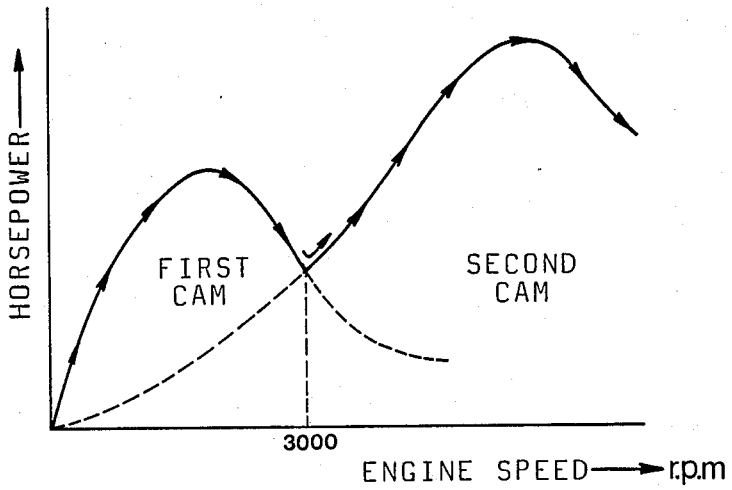
FIG. 8 is a graph showing a relationship between horsepower and engine speed.

FIG. 8 shows the relationship between horsepower and engine speed. It can be seen that large horsepower in the high speed engine range is obtained.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A valve mechanism for an automotive engine having intake valaves and exhaust valves, a cam shaft having cams, and rocker arms rocked by the cams to operate the valves, the mechanism comprising:

at least one of the cams including a first cam for low engine speed, and a second cam for high engine speed which are different in shape of contour;

each of the first and second cams having a common base circle;

one of the rocker arms including a first rocker arm engaging with the first cam, a second rocker arm engaging with the second cam, and an actuating arm disposed between said first and second rocker arms and engaging an end of a valve stem at one end thereof;

the first and second rocker arms and actuating arm being rotatably mounted on a rocker arm shaft so as to be independently rocked;

first means for engaging the actuating arm with the first rocker arm and the second rocker arm so as to be rocked together by the first cam and the second cam;

second means for operating the first means so as to selectively engage and disengage the actuating arm with either of the first and second rocker arms at a time when both the rocker arms engage with the base circles of the corresponding cams at the same time; and wherein the first means comprises holes formed in the first and second rocker arms and actuating arm at positions at which the holes coincide with each other when the rocker arms engage with the base circles, and three pins operated by the second means, the three pins are so arranged that a central pin engaged with the hole of the actuating arm engages with the hole of the first rocker arm or the hole of the second rocker arm.

2. The mechanism according to claim 1 wherein the second means includes a hydraulic cylinder, a piston provided in the hydraulic cylinder and engaged with the end pin.

3. A valve mechanism for an automotive engine having intake valves and exhaust valves, a cam shaft having cams, and rocker arms rocked by the cams to operate the valves, the mechanism comprising:

at least one of the cams including a first cam for low engine speed having a low lobe, and a second cam for high engine speed having a high lobe;

each of the first and second cams having a common base circle;

one of the rocker arms including a first rocker arm engaging with the first cam, a second rocker arm engaging with the second cam, and an actuating arm disposed between the first and second rocker arms and engaging an end of a valve stem at one end thereof;

the first and second rocker arms and actuating arm being rotatably mounted on a rocker arm shaft so as to be independently rocked;

first means comprising holes formed in the first and second rocker arms and actuating arm at positions at which the holes coincide with each other when the rocker arms engage with the base circles, and three pins being arranged such that a central pin engaged with the hole of the actuating arm engages with the hole of the first rocker arm to be rocked by the first cam or the hole of the second rocker arm to be rocked by the second cam; and second means for operating the three pins so as to selectively engage and disengage the actuating arm with either of the first and second rocker arms at a time when both the rocker arms engage with the base circles of the corresponding cams at the same time.

* * * * *